US005561990A

United States Patent [19]

Berkcan et al.

[11] Patent Number: 5,561,990

[45] Date of Patent: Oct. 8, 1996

[54] SYSTEM BASED ON INDUCTIVE COUPLING FOR SENSING SPIN SPEED AND AN OUT-OF-BALANCE CONDITION

[75] Inventors: Ertugrul Berkcan, Schenectady; Kenneth B. Welles, II, Scotia, both of N.Y.

[73] Assignee: General Electric Company, Schenectady, N.Y.

[21] Appl. No.: 491,775

[22] Filed: Jun. 19, 1995

[51] Int. Cl.[6] ..... D06F 33/02; D06F 37/24

[52] U.S. Cl. ..... 68/12.06; 68/12.27; 68/23.3; 68/23.7; 73/779

[58] Field of Search ..... 68/12.02, 12.04, 68/12.06, 23.3, 23.7, 12.27; 73/763, 774, 779, DIG. 5

[56] References Cited

U.S. PATENT DOCUMENTS

| | | | |
|---|---|---|---|
| 3,422,957 | 1/1969 | Fosler | 68/12.06 X |
| 5,269,159 | 12/1993 | Oh | 68/12.06 |
| 5,375,282 | 12/1994 | Dausch et al. | 68/12.06 X |
| 5,375,437 | 12/1994 | Dausch et al. | 68/12.06 |

*Primary Examiner*—Philip R. Coe
*Attorney, Agent, or Firm*—Marvin Snyder

[57] ABSTRACT

A system for sensing spin speed and an out-of-balance condition in a washing machine is provided. The washing machine includes a washer basket and an agitator that spin about a predetermined spin axis during a spin cycle. The OOB condition can be characterized by excursions, during the spin cycle, of a tub which encloses the washer basket. The tub excursions can be in a direction generally perpendicular to the spin axis of the washer basket, for example. The system includes a magnetic source, such as a permanent magnet, positioned in the agitator for producing a predetermined magnetic field. A magnetic sensor is positioned to be electromagnetically coupled to the magnetic source for supplying an output signal that varies as the agitator rotates relative to the magnetic sensor. A signal processor is coupled to the magnetic sensor for receiving the output signal supplied by the magnetic sensor. The processor is programmed for measuring spin speed during the spin cycle and for detecting any out-of-balance condition during the spin cycle based on the variations of the output signal received from the magnetic sensor.

23 Claims, 8 Drawing Sheets

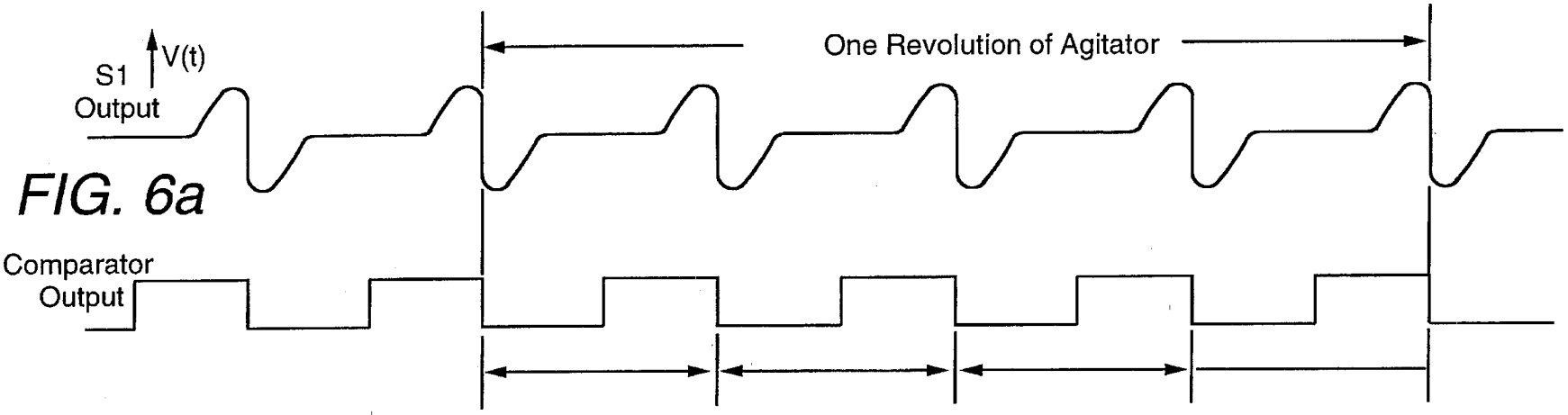
FIG. 6a
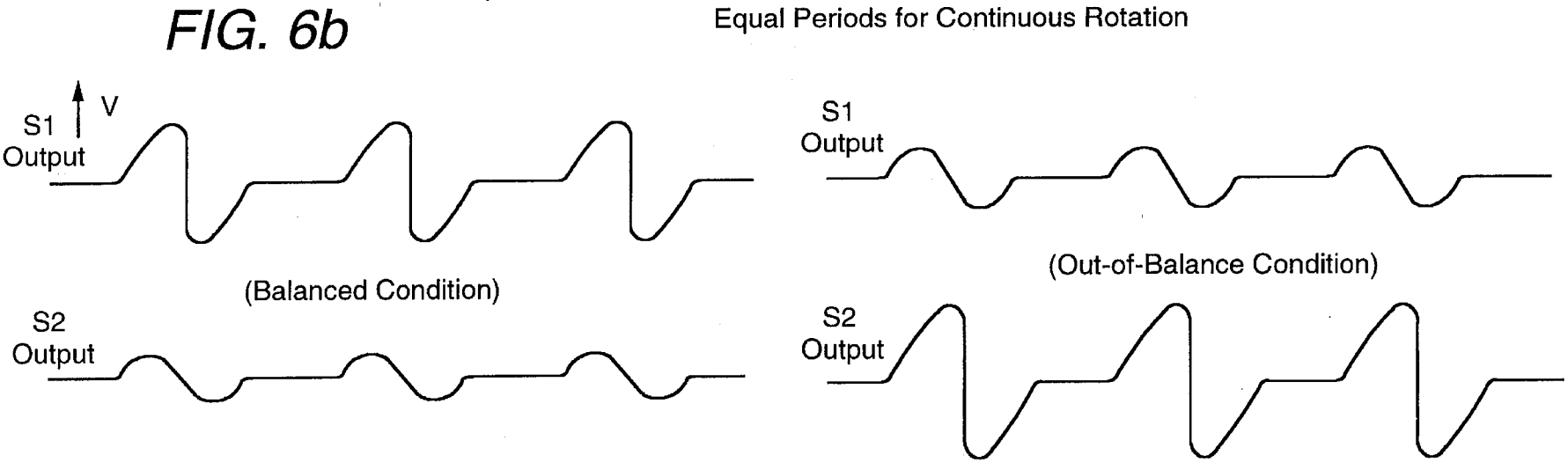
FIG. 6b
FIG. 8b
FIG. 8a

SYSTEM BASED ON INDUCTIVE COUPLING FOR SENSING SPIN SPEED AND AN OUT-OF-BALANCE CONDITION

RELATED APPLICATIONS

This application is related to patent applications Ser. No. (08/491,777) (RD-24,467), entitled "System Based On Inductive Coupling For Sensing Loads In a Washing Machine By measuring Angular Acceleration", and Ser. No. (08/491,776) (RD-24,441) entitled "System Based On Inductive Coupling For Sensing Loads In a Washing Machine ", each filed concurrently with the present invention, assigned to the same assignee of the present invention and herein incorporated by reference.

BACKGROUND OF THE INVENTION

The present invention is generally related to washing machines and, more particularly, to a system based on inductive coupling for sensing spin speed and an out-of-balance (OOB) condition which can arise during the operation of the washing machine.

In a typical washing machine (such as a top or front-loading washing machine) the OOB condition can actually occur during a spin cycle, for example, when the articles to be cleansed, such as clothing and the like, bunch up asymmetrically at various locations in the basket for holding such articles. For various detrimental reasons the OOB condition is not desirable if left uninterrupted. For example, a tub which encloses the basket may violently strike the cabinet of the washing machine and thus cause damage either to the tub, the cabinet or both. Further, unacceptable stress forces can develop during the OOB condition that can affect the suspension mechanism of the washing machine as well as other components thereof such as the transmission or other suitable connecting device which links the motor of the washing machine to the spinning basket. Regardless of whether the OOB condition actually develops during any given spin cycle, it is useful to accurately sense or measure spin speed during the spin cycle. For example, this measurement can be used for determining transmission and/or motor performance under various load conditions. It is thus desirable to provide a system for sensing spin speed and for sensing any OOB condition which can arise in the washing machine. It is also desirable for this sensing system to be low cost and reliable, i.e., a robust sensing system which does not require elaborate logic to sense spin speed and any OOB condition in the washing machine, and which does not need frequent calibration or resetting.

SUMMARY OF THE INVENTION

Generally speaking, the present invention fulfills the foregoing needs by providing a system for sensing spin speed and an out-of-balance condition in a washing machine which typically includes a washer basket and agitator that typically spin about a predetermined spin axis during a spin cycle. The OOB condition can be characterized by excursions during a spin cycle of a tub which encloses the washer basket. The tub excursions can be in a direction generally perpendicular to the spin axis of the washer basket, for example. An exemplary embodiment for the system comprises a magnetic source, such as a permanent magnet, positioned in the agitator for producing a predetermined magnetic field. A magnetic sensor, made-up of inductive coils; or solid state sensors, such as magnetoresistive and Hall-effect solid state magnetic sensor, is positioned to be electromagnetically coupled to the magnetic source for supplying an output signal that varies as the agitator rotates relative to the magnetic sensor, and a signal processor is coupled to the magnetic sensor for receiving the output signal supplied by the magnetic sensor. The processor is designed and/or programmed for measuring spin speed during the spin cycle and for detecting any out-of-balance condition during the spin cycle based on the output signal received from the magnetic sensor.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following detailed description in conjunction with the accompanying drawings in which like numerals represent like parts throughout the drawings, and in which:

FIG. 6*a* shows an exemplary waveform for the output signal supplied by the set of sensing coils of FIG. 5*a* while FIG. 6*b* shows an exemplary waveform of the output signal from the comparator of FIG. 5*b;*

FIG. 8*a* shows exemplary waveforms for the respective output signals supplied by the two sets of sensing coils of FIG. 7*a* during a balanced condition while FIG. 8*b* shows exemplary waveforms during the OOB condition of FIG. 7*a;*

FIG. 10*a* shows respective exemplary waveforms for the coil and comparator output signals during the balanced condition while

DETAILED DESCRIPTION OF THE INVENTION

Figure 1:
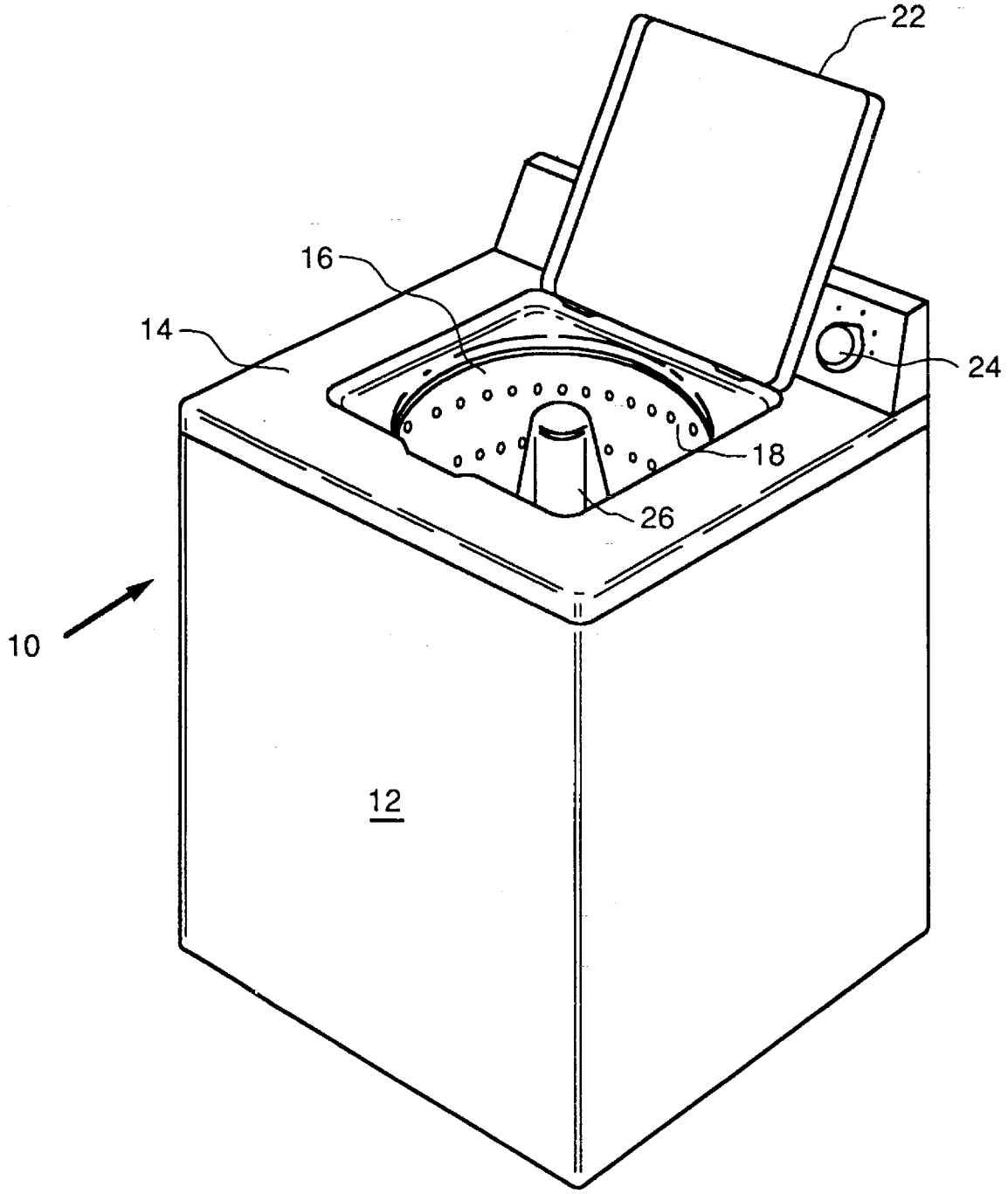
FIG. 1 is a perspective view of a typical top-loading washing machine.

FIG. 1 illustrates a top loading washing machine 10 which has a cabinet 12 having a respective top panel 14 with an access opening 16 for loading and unloading articles to be cleansed in a washer basket 18. In a conventional washing operation, the articles to be cleansed are loaded through access opening 16 into basket 18, and after lid 22 is closed and a control knob 24 or other suitable control device is properly set, the washing machine sequences through a predetermined sequence of cycles such as wash, rinse and spin cycles. An agitator 26 is generally positioned in basket 18 to agitate or scrub the articles to be cleansed during the wash and rinse cycles, for example.

Figure 2A:
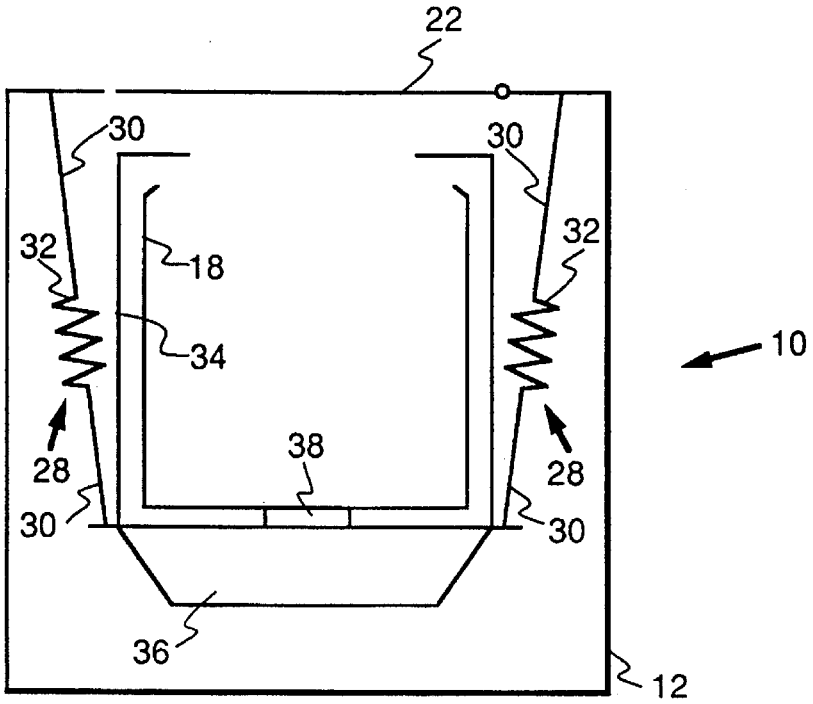
FIG. 2*a* is a simplified schematic representation illustrating an exemplary suspension for the washing machine shown in FIG. 1.

FIG. 2*a* shows a simplified schematic representation illustrating an exemplary suspension 28 used in washing machine 10 to provide mechanical isolation and support with respect to cabinet 12 of components such as washer basket 18, a tub 34, a motor 36 and a transmission 38. Suspension 28 typically comprises connecting rods 30 and springs 32 suitably selected in accordance with the particular mechanical characteristics of a given washing machine. During the wash and rinse cycles, tub 34 is filled with water and agitator 26 (not shown in FIGS. 2*a* and 2*b*) may be driven back and forth by motor 36 respectively linked to agitator 26 and basket 18 by transmission 38, for example.

Figure 2B:
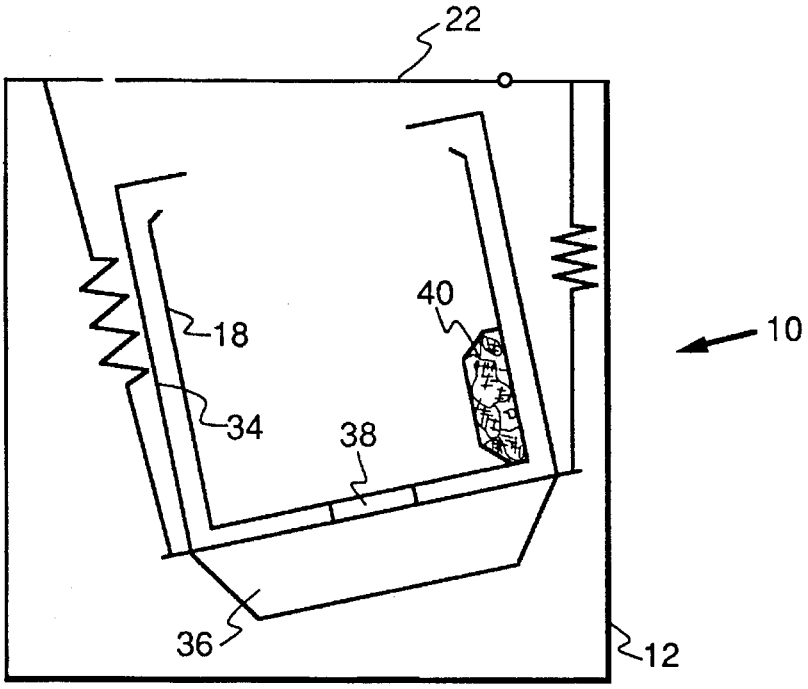
FIG. 2*b* illustrates the representation of FIG. 2*a* during an out-of-balance (OOB) condition.

FIG. 2*b* illustrates a condition herein referred to as out-of-balance (OOB) condition which can arise during a spin cycle, as basket 18 is rotated about its spin axis by motor 36 at a relatively high spin speed to extract moisture from articles 40. The OOB condition for purposes of illustration can be characterized in terms of excursions of tub 34 in a direction generally perpendicular to the spin axis during the spin cycle, for example. In the case of a top-loading washing machine, such spin axis may be generally situated in a substantially vertical plane whereas in a front-loading washing machine such spin axis may be generally situated in a substantially horizontal plane. As seen in FIG. 2B in the context of a top-loading washing machine, articles 40 may asymmetrically bunch up at various height locations in spinning basket 18 and due to the resulting load unbalance in combination with the centrifugal force generated during the spin cycle, tub 34 may initially oscillate substantially symmetrically about the spin axis. However, depending on the severity of the load unbalance, the tub may eventually oscillate uncontrollably so as to strike cabinet 12 as well as to impose undue stress force on various components of the washing machine such as the transmission, suspension and other such washing machine components. It should be appreciated that the foregoing OOB condition can develop regardless of the specific orientation of the spin axis of the washer basket and thus the present invention can be readily adapted for use in either top or front-loading washing machines.

Figure 3:
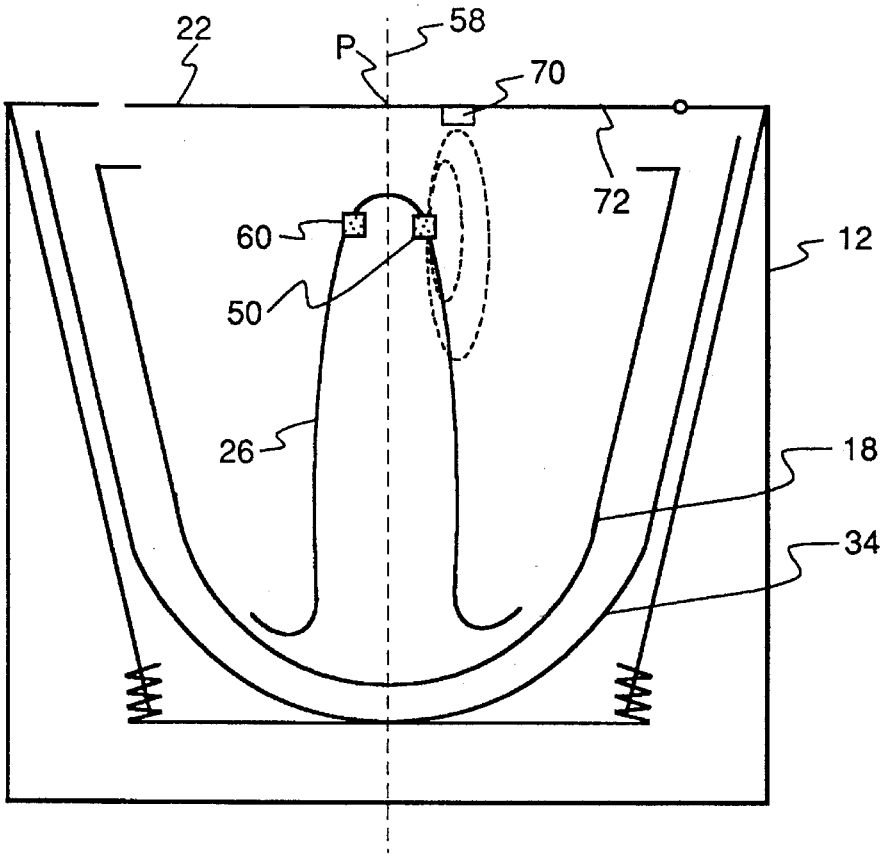
FIG. 3 is a side view schematic of a washing machine incorporating a sensing system in accordance with one exemplary embodiment for the present invention.

In accordance with one exemplary embodiment for the present invention, FIG. 3 shows a magnetic source 50, such as a permanent magnet, that can be positioned substantially near the tip of agitator 26 for producing a predetermined magnetic field. As shown in FIG. 3, magnetic source 50 is positioned off-axis relative to the spin axis 58 of the washer basket. During a balanced condition, spin axis 58 generally intersects lid 22 at a point P located on an inner surface 72 of lid 22. A suitable counterweight 60 (or another magnet) can be positioned opposite magnetic source 50 for maintaining balance of agitator 26 during spin cycles. FIG. 3 further shows a magnetic sensor 70 attached to inner surface 72 of lid 22 and positioned substantially near the tip of agitator 26 so as to be magnetically coupled to magnetic source 50 for producing an output signal that varies as the agitator rotates relative to sensor 70, i.e., as the magnet passes near the magnetic sensor. It will be appreciated by those skilled in the art that other locations for the magnetic sensor and the magnetic source can be provided depending on the specific application. For example, if only spin speed sensing is desired and assuming a suitable nonmagnetic material is employed for the tub and the washer basket, then the magnetic source could be attached near the base of the agitator while the magnetic sensor could be attached at a corresponding base section of the tub.

Figure 4:
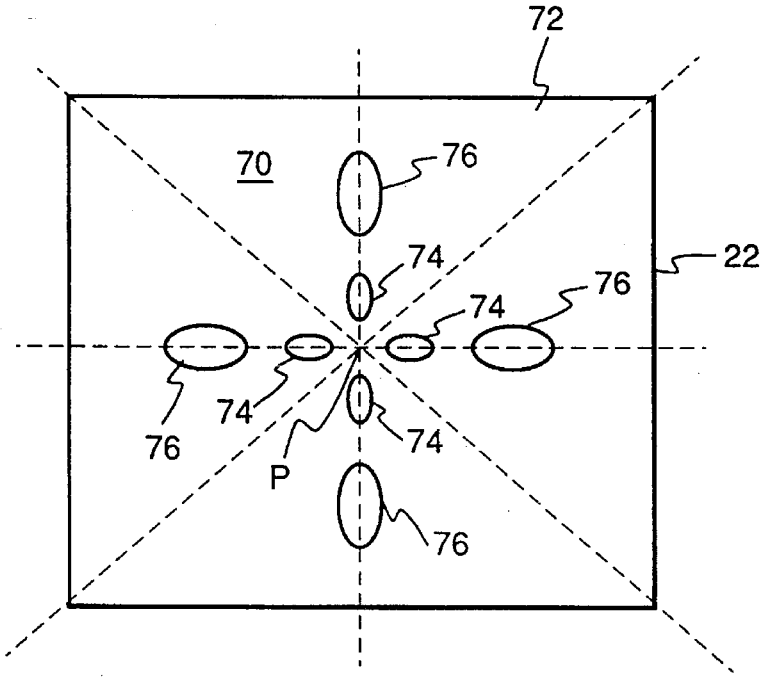
FIG. 4 is a bottom view schematic of the lid of the washing machine showing an exemplary arrangement for magnetic sensors attached to the lid.

FIG. 4 shows an exemplary embodiment for magnetic sensor 70. In this embodiment, magnetic sensor 70 is made up of a first set of four mutually spaced inductive coils 74 affixed to inner surface 72 of lid 22. By way of example and not of limitation, each coil 74 in this first set is positioned substantially equidistant at a predetermined distance from point P on the inner surface of the lid. As shown in FIG. 4, each coil 74 is positioned at a predetermined angle with respect to one another on the plane defined by inner surface 72. This predetermined angle can be conveniently chosen to position respective ones of coils 74 in substantially equiangular relationship relative to one another. FIG. 4 further shows a second set of four mutually spaced coils 76 affixed to the inner surface of lid 22 and being outwardly positioned relative to the first set of coils 74. The angular positioning of coils 76 relative to coils 74 is not important, however, for the sake of signal processing simplicity, each coil 76 should be preferably positioned substantially equidistant at another predetermined distance from point P so that each coil 76 in the second set is outwardly positioned relative to each coil 74 in the first set. For the purpose of graphical distinction, in FIG. 4, each coil 74 that makes up the first set of coils is shown to be smaller than each coil 76 that makes up the second set of coils, however, in actual practice each of coils 74 and 76 can be chosen substantially identical to one another. It will be appreciated by those skilled in the art that the actual number of coils in the first and second sets is not critical being that even a single coil per set could be used for sensing spin speed and the OOB condition. The actual number of coils is readily chosen based on the desired resolution and accuracy for the sensing system being that system resolution and accuracy are proportional to the number of sensing coils employed. Further, the use of a second set of coils is only optional since depending on the particular implementation even a single set with a single coil could be used for sensing spin speed and the OOB condition. Although the above description for magnetic sensor 70 was made in terms of inductive coils, it will be appreciated by those skilled in the art that the magnetic sensor need not be limited to inductive coils being that solid state magnetic sensors, such as Hall-effect sensors, magnetoresistive sensors and the like, could be conveniently employed in lieu of inductive coils.

Figure 5A:
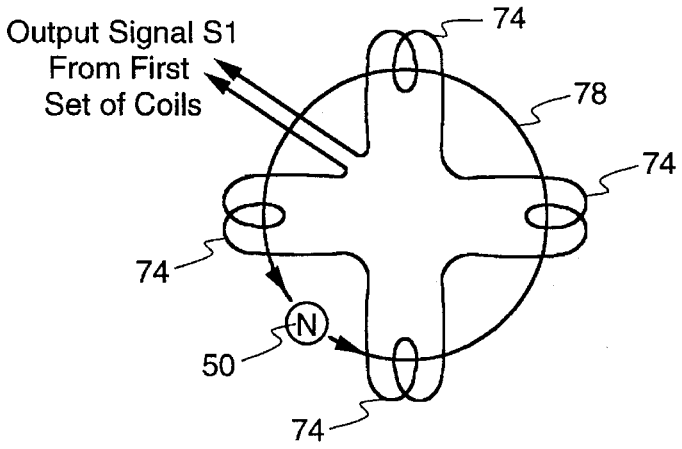
FIG. 5*a* shows a schematic diagram for one set of sensing coils connected to supply an output signal capable of being processed for measuring spin speed and including an exemplary magnet path during a spin cycle.
Figure 5B:
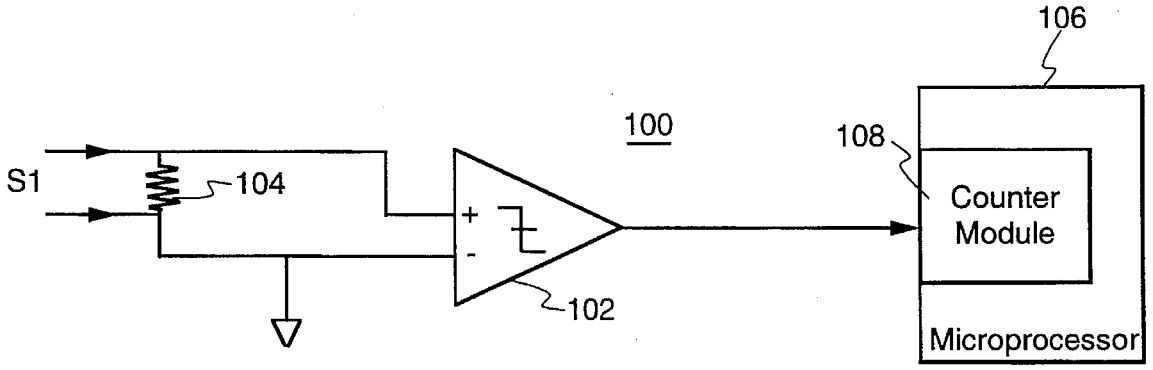
FIG. 5*b* shows a schematic diagram of an exemplary signal processor including a comparator for receiving the output signal from the set of sensing coils of FIG. 5*a;*

FIG. 5*a* shows an exemplary connection for the first set of coils 74. As shown in FIG. 5*a* each coil 74 is serially coupled to one another so that the first set of coils supplies a combined output signal S1 capable of being processed for measuring spin speed. FIG. 5*a* further shows an exemplary path 78 for magnet 50 relative to coils 74 as the agitator rotates during the spin cycle. FIG. 5*b* illustrates a signal processor 100 that processes the output signal S1 from coils 74 to determine spin speed. As shown in FIG. 5*b*, signal processor 100 includes a comparator 102 having two input ports, coupled through a suitable resistor 104, for receiving the output signal from the first set of coils 74. Comparator 102 supplies a comparator output signal that during spin cycles provides a substantially periodic stream of pulses based on the polarity of the received output coil signal. As best shown in FIG. 6*b*, each cycle of the comparator output signal has a substantially identical period or cycle length with respect to each other. The comparator output signal is supplied to a microprocessor 106 having a counter module 108 which readily allows for measuring spin speed based on the number of pulses received per unit of time, i.e., spin speed is proportional to the pulse rate. For example, the pulse count can be readily averaged over a suitable period of time so as to provide an average measurement for the spin speed.

FIG. 6*a* shows an exemplary waveform for the output signal S1 supplied by the first set of coils 74 while FIG. 6*b* shows an exemplary waveform for the comparator output signal. As suggested above, spin speed can be accurately measured by simply counting the number of pulses per unit of time. In the case of a coil set made up of four sensing coils, four pulses will be generated per each revolution of the washer basket and agitator. If for example, the counter counts 16 pulses per second, then spin speed is four revolutions per second. It will be appreciated that one important advantage of the present invention is its simplicity of implementation. This allows for providing, at a low cost, a reliable and versatile sensing system.

Figure 7A:
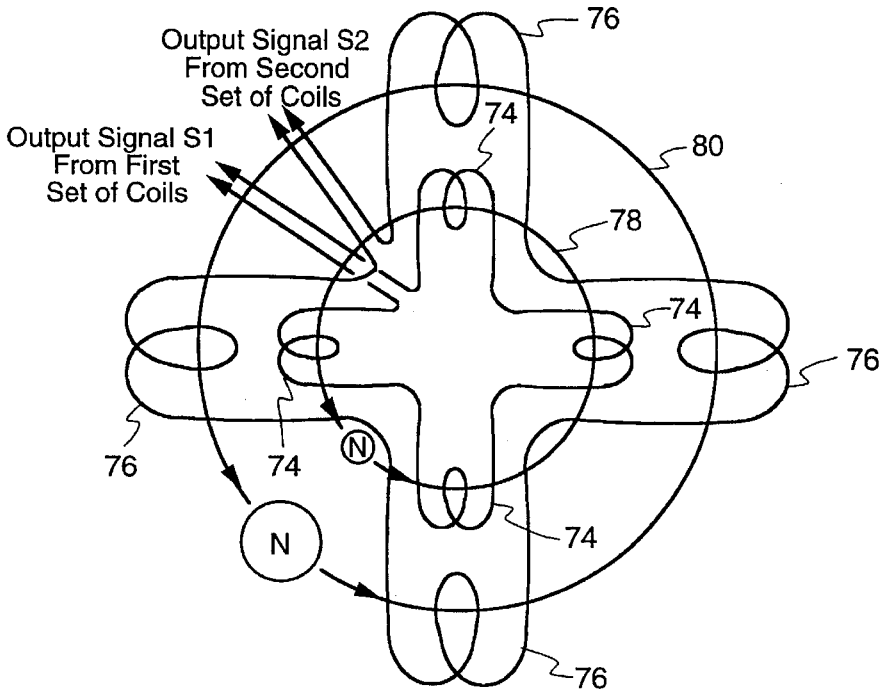
FIG. 7*a* shows a schematic diagram for two sets of sensing coils connected to supply respective output signals capable of being processed for sensing one exemplary OOB condition and including respective illustrative magnet paths during this OOB condition and during a balanced condition.

FIG. 7*a* shows exemplary respective connections for the first set of coils 74 and for the second set of coils 76 for detecting the OOB condition. During a balanced condition, the first set of coils 74 supplies an output signal S1 as described above in the context of FIGS. 5 and 6. In contrast, due to the outwardly spatial relationship of the second set of coils 76 relative to the first set of coils 74, the output signal S2 provided by the second set of coils during a balanced condition will generally have lower peak-to-peak values as compared to the output signal from the first set of coils. Respective exemplary waveforms for the S1 and S2 output signals during a balanced condition are shown in FIG. 8*a*. As will be understood by those skilled in the art, for a relatively benign load unbalance, the OOB condition can be characterized by substantially symmetrical excursions or oscillations of the tub so that the magnet travels in a relatively predictable path relative to the sensing coils, such as conceptualized by a path 80. As shown in FIG. 7*a*, during this OOB condition, the radius of path 80 is larger than the radius of a path 78 traveled by the magnet during the balanced condition, and thus the output signal S2 from the second set of coils 76 will now have larger peak-to-peak values than those for the output signal from coils 52. Respective exemplary waveforms for the S1 and S2 output signals during the above-described OOB condition are shown in FIG. 8*b*.

Figure 7B:
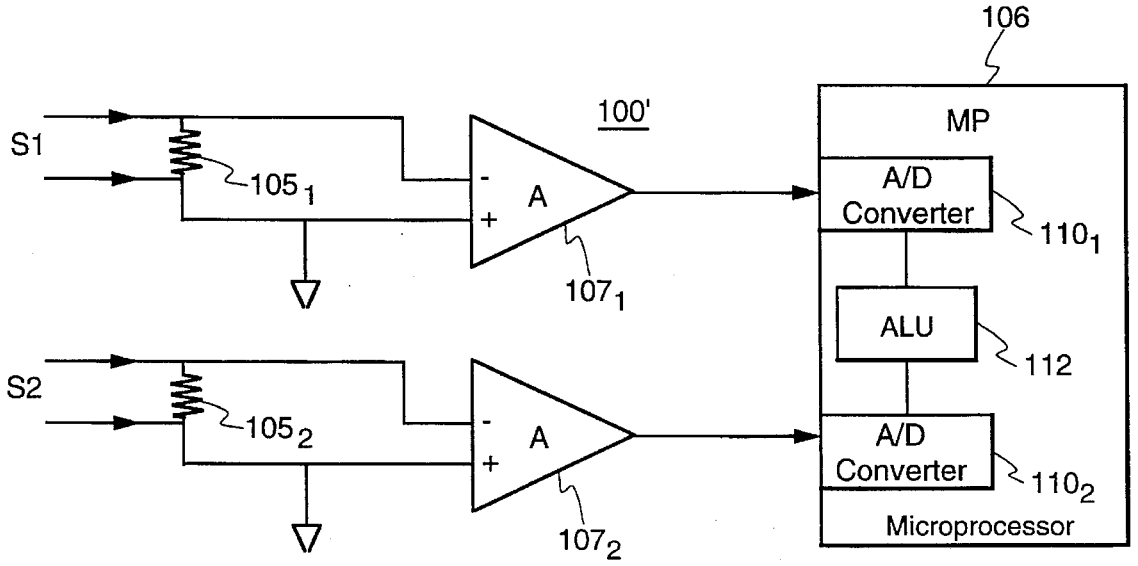
FIG. 7*b* shows a schematic diagram of an exemplary signal processor for processing the respective output signals supplied from the two set of sensing coils of FIG. 6A so as to determine the presence of the OOB condition of FIG. 7*a;*

FIG. 7*b* shows a signal processor 100' that allows for determining the presence of the OOB condition described in the context of FIG. 7*a* by performing relatively simple signal processing on the output signals S1 and S2 respectively supplied from the first and second sets of coils. As shown in FIG. 7*b*, signal processor 100' includes a first amplifier, such as an operational amplifier $\mathbf{107}_1$ having two input ports, coupled through a suitable resistor $\mathbf{105}_1$, for receiving output signal S1 from the first set of coils 74. Signal processor 100' further includes a second amplifier, such as an operational amplifier $\mathbf{107}_2$ having two input ports, coupled through a suitable resistor $\mathbf{105}_2$, for receiving output signal S2 from the second set of coils 76. For example, after respective suitable amplification of signals S1 and S2 in operational amplifiers $\mathbf{107}_1$ and $\mathbf{107}_2$, each amplifier output signal is supplied to microprocessor 106 to be digitized using respective analog-to-digital converters $\mathbf{110}_1$ and $\mathbf{110}_2$. An arithmetic logic unit (ALU) 112 in microprocessor 106 allows for taking the ratio of the respective digitized signals so as to determine the presence of the OOB condition. For example, if the ratio of the digitized output signal from the first set of coils over the digitized output signal from the second set of coils is computed in ALU 112, then during a balanced condition such ratio will be typically larger than unity while during the 00B condition such ratio will be typically below unity. Once the presence of the OOB condition is determined, control instructions stored in a memory (not shown) allow microprocessor to 106 to issue appropriate commands for interrupting or correcting the OOB condition.

Figure 9A:
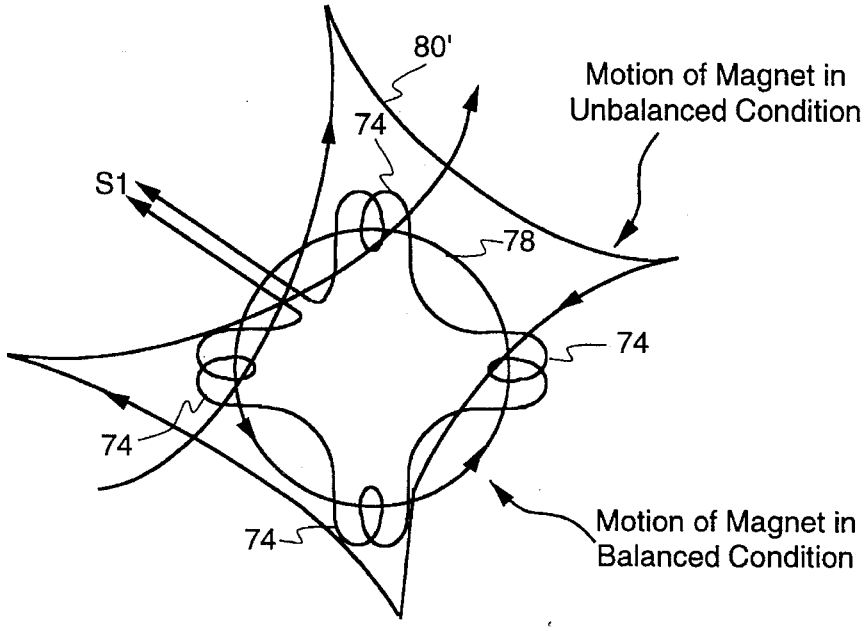
FIG. 9*a* shows a schematic diagram for a single set of sensing coils connected to supply an output signal capable of being processed for sensing another exemplary OOB condition and including respective illustrative magnet paths during this OOB condition and during a balanced condition.
Figure 10A:
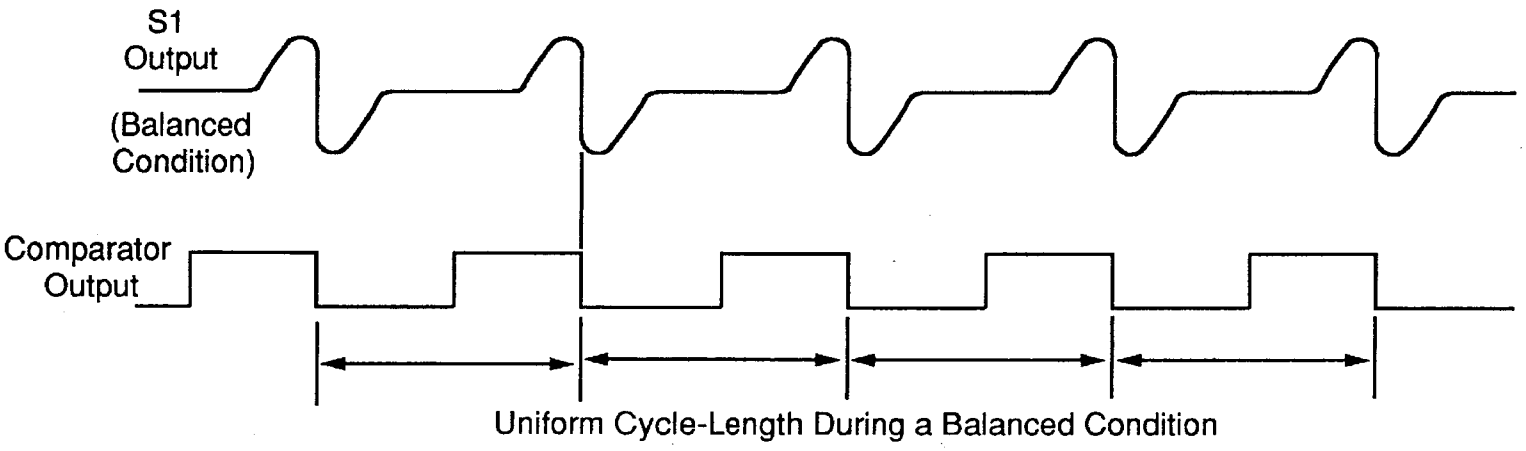
Figure 10B:
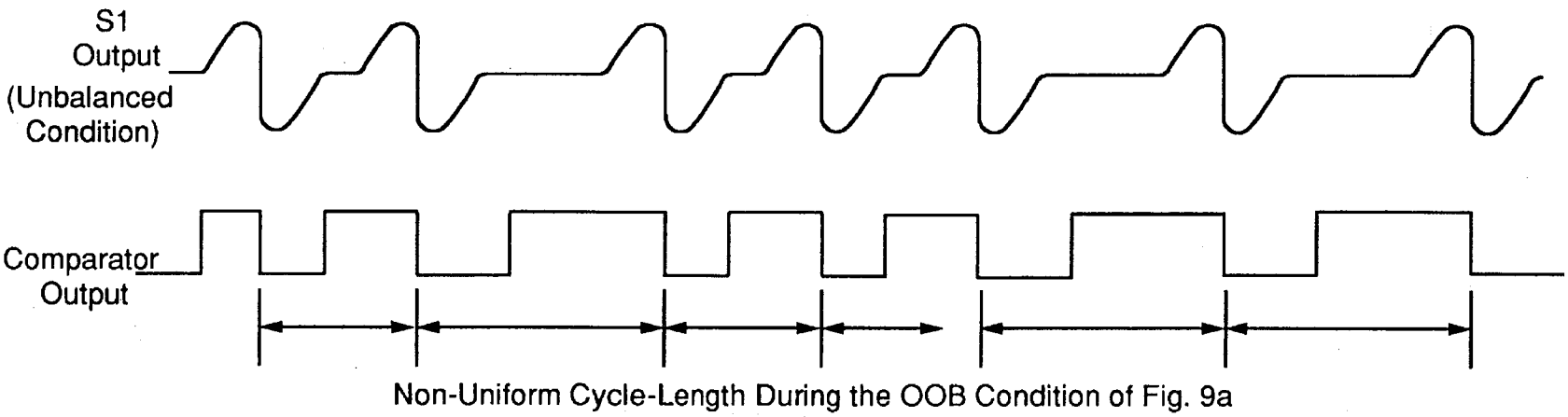
FIG. 10*b* shows respective exemplary waveforms of the coil and comparator output signals during the OOB condition of FIG. 9*a;*

FIG. 9*a* shows a connection for a single set of coils as previously described in the context of FIG. 5*a*. As previously suggested, depending upon the severity of the load unbalance, the OOB condition can be characterized by substantially asymmetric excursions of the tub so that the magnet travels in a relatively unpredictable or chaotic path 80' relative to each coil of the single set of coils. During a balanced condition, exemplary waveforms for the coil output signal S1 and the comparator output signal may be as shown in FIG. 10*a*; while during this OOB condition exemplary waveforms for the output may be as shown in FIG. 10*b*. Thus, during this OOB condition, instead of each cycle of the comparator output signal having a substantially similar period or cycle-length with respect to one another, in this OOB condition, each respective cycle-length or period for the stream of cycles that makes up the comparator output signal is generally uneven with respect to one another. Thus by measuring or monitoring cycle-length deviation, this OOB condition can be detected.

Figure 9B:
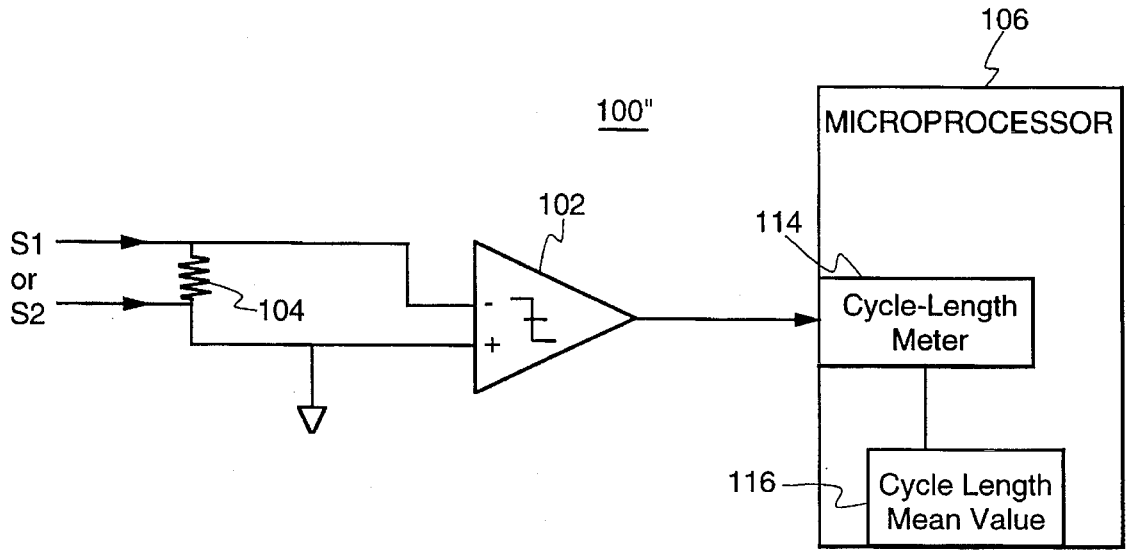
FIG. 9*b* shows a schematic diagram of an exemplary signal processor for processing the output signal from the single set of coils of FIG. 9*a* so as to determine the presence of the OOB condition of FIG. 9*a*.

FIG. 9*b* shows a signal processor 100" that allows for determining the presence of the OOB condition described in the context of FIG. 9*a* by again performing relatively simple signal processing on the output signal S1 from the first set of coils or, alternatively, on the output signal S2 from the second set of coils. In this case the stream of pulses in the comparator output signal is supplied to a cycle-length metering device 114 which, over a suitable time interval, measures, for example, the cycle-length standard deviation from a predetermined cycle-length mean value stored in a memory 116. It can be shown that during a balanced condition, the difference between the measured cycle-length standard deviation and the mean value stored in memory 116 would be relatively low because each cycle in the stream of cycles that makes up the comparator output signal has a length or period substantially identical to each other. Conversely, during the OOB condition, the difference between the measured cycle-length standard deviation and the value stored in memory 116 would be relatively high because of the random or uneven cycle-length in the comparator output signal. As suggested above, once the presence of the OOB condition is determined, control instructions stored in a memory unit (not shown) would readily allow microprocessor 106 to issue appropriate commands for correcting or interrupting the OOB condition. It will be appreciated by those skilled in the art that the above-described signal processors embodiments for sensing, respectively, spin speed and the OOB condition can be readily integrated in a common microprocessor. Further, it will be appreciated that the signal polarity comparison performed on the coil output signal by any external comparator device could be alternatively implemented directly in the microprocessor using, for example, a suitable zero-crossing detection algorithm for performing the signal polarity comparison on the coil output signal.

While only certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

What is claimed is:

1. A washing machine comprising:

a cabinet having a lid;

a tub being inside said cabinet;

a washer basket for holding articles to be cleansed, said basket being positioned in said tub;

an agitator for agitating the articles to be cleansed during respective wash and rinse cycles, said agitator positioned in said washer basket;

means for rotating said washer basket and said agitator about a predetermined spin axis during a spin cycle;

said tub being susceptible to an out-of-balance condition characterized by excursions of said tub in a direction generally perpendicular to said spin axis during said spin cycle;

a system comprising:

a magnetic source positioned in said agitator for producing a predetermined magnetic field;

a magnetic sensor positioned to be electromagnetically coupled to said magnetic source for supplying an output signal that varies as said agitator rotates relative to said magnetic sensor; and a signal processor coupled to said magnetic sensor for receiving the output signal supplied by said magnetic sensor, said processor being adapted for measuring spin speed during said spin cycle and for detecting any out-of-balance condition during said spin cycle based on the output signal received from said magnetic sensor.

2. The washing machine of claim 1 wherein said magnetic source is positioned substantially at the tip of said agitator.

3. The washing machine of claim 2 wherein said magnetic sensor comprises a first set of mutually spaced coils affixed to an inner surface of the lid of said washing machine.

4. The washing machine of claim 3 wherein each coil in said first set is positioned substantially equidistant from a point in said inner surface intersected by said spin axis.

5. The washing machine of claim 4 wherein each coil in said first set is positioned at a predetermined angle with respect to one another.

6. The washing machine of claim 5 wherein said predetermined angle is chosen to position respective ones of said mutually spaced coils in substantially equiangular relationship relative to one another.

7. The washing machine of claim 6 wherein said magnetic sensor further comprises a second set of mutually spaced coils affixed to the inner surface of the lid of said washing machine.

8. The washing machine of claim 6 wherein said second set of coils is outwardly positioned relative to said first set of coils.

9. The washing machine of claim 8 wherein said signal processor comprises first and second operational amplifiers coupled to receive, respectively, the output signals from said first and second sets of coils and a microprocessor coupled to said first and second amplifiers for processing the respective output signals from said first and second amplifiers so as to determine spin speed and the presence of any out-of-balance condition during said spin cycle.

10. The washing machine of claim 3 wherein said signal processor comprises a comparator coupled to receive the output signal from said first set of coils and a microprocessor coupled to said comparator for processing the comparator output signal so as to determine spin speed and the presence of any out-of-balance condition during said spin cycle.

11. The washing machine of claim 2 wherein said magnetic sensor comprises a first set of mutually spaced solid state magnetic sensors affixed to an inner surface of the lid of said washing machine.

12. The washing machine of claim 11 wherein each sensor in said first set of mutually spaced solid state magnetic sensors is selected from the group consisting of magnetoresistive and Hall-effect solid state magnetic sensors.

13. A system for sensing spin speed and an out-of-balance condition in a washing machine having a tub inside a cabinet with a lid, said tub enclosing a washer basket for holding articles to be cleansed and an agitator for agitating said articles during respective wash and rinse cycles, said washing machine including means for spinning said basket and said agitator about a predetermined spin axis during a spin cycle, said tub being susceptible to an out-of-balance condition characterized by excursions of said tub in a direction generally perpendicular to said spin axis during said spin cycle, said system comprising:

a magnetic source positioned in said agitator for producing a predetermined magnetic field;

a magnetic sensor positioned to be electromagnetically coupled to said magnetic source for supplying an output signal that varies as said agitator rotates relative to said magnetic sensor; and a signal processor coupled to said magnetic sensor for receiving the output signal supplied by said magnetic sensor, said processor being adapted for measuring spin speed during said spin cycle and for detecting any out-of-balance condition during said spin cycle based on the output signal received from said magnetic sensor.

14. The system of claim 13 wherein said magnetic source is positioned substantially at the tip of said agitator.

15. The system of claim 14 wherein said magnetic sensor comprises a first set of mutually spaced coils affixed to an inner surface of the lid of said washing machine.

16. The system of claim 15 wherein each coil in said first set is positioned substantially equidistant from a point in said inner surface intersected by said spin axis.

17. The system of claim 16 wherein each coil in said first set is positioned at a predetermined angle with respect to one another.

18. The system of claim 17 wherein said predetermined angle is chosen to position respective ones of said mutually spaced coils in substantially equiangular relationship relative to one another.

19. The system of claim 18 wherein said magnetic sensor further comprises a second set of mutually spaced coils affixed to the inner surface of the lid of said washing machine.

20. The system of claim 18 wherein said second set of coils is outwardly positioned relative to said first set of coils.

21. The system of claim 20 wherein said signal processor comprises first and second operational amplifiers coupled to receive, respectively, the output signals from said first and second sets of coils and a microprocessor coupled to said first and second amplifiers for processing the respective output signals from said first and second amplifiers so as to determine spin speed and the presence of any out-of-balance condition during said spin cycle.

22. The system of claim 15 wherein said signal processor comprises a comparator coupled to receive the output signal from said first set of coils and a microprocessor coupled to said comparator for processing the comparator output signal so as to determine spin speed and the presence of any out-of-balance condition during said spin cycle.

23. The system of claim 13 wherein said magnetic sensor comprises a solid state magnetic sensor selected from the group consisting of magnetoresistive and Hall-effect solid state magnetic sensors.

* * * * *